US010052887B1

(12) United States Patent
Norte

(10) Patent No.: US 10,052,887 B1
(45) Date of Patent: Aug. 21, 2018

(54) SERPENTINE MICROWAVE DRYERS FOR PRINTING SYSTEMS

(71) Applicant: Andrew David Norte, Westminster, CO (US)

(72) Inventor: Andrew David Norte, Westminster, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/440,649

(22) Filed: Feb. 23, 2017

(51) Int. Cl.

| | |
|---|---|
| ***B41J 11/00*** | (2006.01) |
| ***H05B 6/78*** | (2006.01) |
| ***F26B 13/14*** | (2006.01) |
| ***F26B 3/347*** | (2006.01) |

(52) U.S. Cl.
CPC ..... *B41J 11/0015* (2013.01); *F26B 3/347* (2013.01); *F26B 13/14* (2013.01); *H05B 6/78* (2013.01); *H05B 2206/046* (2013.01)

(58) Field of Classification Search
CPC ..... H05B 6/78; H05B 2206/046
See application file for complete search history.

(56) References Cited

U.S. PATENT DOCUMENTS

| | | | | |
|---|---|---|---|---|
| 4,214,379 | A | 7/1980 | Hope et al. | |
| 4,570,045 | A | 2/1986 | Jeppson | |
| 5,422,463 | A | 6/1995 | Gooray et al. | |
| 5,958,275 | A | 9/1999 | Joines et al. | |
| 6,259,077 | B1 * | 7/2001 | Drozd | H05B 6/701 219/692 |
| 6,470,597 | B1 | 10/2002 | Stipp | |
| 6,525,752 | B2 | 2/2003 | Vackier et al. | |
| 6,906,297 | B2 | 6/2005 | Tops | |
| 7,014,309 | B2 | 3/2006 | Aukerman | |
| 7,091,457 | B2 | 8/2006 | Gregoire et al. | |
| 7,211,299 | B2 | 5/2007 | Siegel | |
| 7,298,994 | B2 | 11/2007 | Morgenweck et al. | |
| 8,426,784 | B2 * | 4/2013 | Drozd | H05B 6/701 219/695 |
| 8,955,957 | B2 | 2/2015 | Boland et al. | |
| 9,327,524 | B1 | 5/2016 | Yamada et al. | |

(Continued)

OTHER PUBLICATIONS

Frederick W. Ahrens; Application of a Device for Uniform Web Drying and Preheating Using Microwave Energy; Final Report; Sep. 2003, entire document.

*Primary Examiner* — Shelby Fidler
(74) *Attorney, Agent, or Firm* — Duft Bornsen & Fettig LLP

(57) ABSTRACT

Serpentine microwave dryers and a method of fabricating same are disclosed. The serpentine microwave dryers utilize microwave waveguides that includes passages through a short axis of the microwave waveguides that are sized to pass a continuous-form print medium. A long axis of the microwave waveguides are positioned across a width of a media path of the continuous-from print medium. Electromagnetic energy transported along the microwave waveguides is used to dry wet colorants applied to the continuous-form print medium. At least one of the microwave waveguides has an offset from other microwave waveguides that is perpendicular to the media path of the continuous-form print medium. The offset reduces an attenuation of the electromagnetic energy in microwave waveguide(s) that are offset.

20 Claims, 8 Drawing Sheets

(56) References Cited

U.S. PATENT DOCUMENTS

| | | | | |
|---|---|---|---|---|
| 2003/0081098 | A1* | 5/2003 | Wotton | B41J 11/002 347/102 |
| 2014/0103031 | A1* | 4/2014 | Peelamedu | H05B 6/6482 219/700 |
| 2015/0210089 | A1* | 7/2015 | Biegelsen | B41J 11/002 347/102 |
| 2016/0013056 | A1 | 1/2016 | Kasai et al. | |
| 2016/0309549 | A1 | 10/2016 | Kimrey et al. | |

* cited by examiner

OFFSET WAVEGUIDES

SERPENTINE MICROWAVE DRYERS FOR PRINTING SYSTEMS

FIELD OF THE INVENTION

The invention relates to the field of printing systems, and in particular, to serpentine microwave dryers that are used to dry liquid materials that are applied to a print media by the printing system.

BACKGROUND

Production printing systems for high-volume printing typically utilize a production printer that marks a continuous-form print medium (e.g., paper) with a wet colorant (e.g., an aqueous ink). After marking the continuous-form print medium, a dryer downstream from the production printer is used to dry the colorant applied to the continuous-form print medium. Serpentine microwave dryers may be employed as a dryer for a production printing system in some applications.

A serpentine microwave dryer utilizes microwave energy to heat the colorant to cause a liquid portion of the colorant to evaporate, thereby fixing the colorant to the continuous-form print medium. A microwave source directs the microwave energy down a long axis of a waveguide, and a passageway through a short axis of the waveguide is sized to pass the continuous-form print medium through the waveguide. As the continuous-form print medium traverses the passageway, the wet colorants applied to the continuous-form print medium are exposed to the microwave energy and are heated. In a serpentine microwave dryer, the waveguides have a long axis that traverses the width of the print medium. The waveguides are electromagnetically coupled together in a row along a media path of the continuous-form print medium, and are aligned in the same plane.

One problem with serpentine microwave dryers is that the electromagnetic energy through successive waveguides is attenuated along the media path. The result is that waveguides at the end of the row farthest from the microwave source exhibit a lower microwave power than the waveguides at the front closest to the microwave source. This reduces the drying efficiency of the microwave dryer.

SUMMARY

Serpentine microwave dryers and a method of fabricating same are disclosed. The serpentine microwave dryers utilize microwave waveguides that includes passages through a short axis of the microwave waveguides that are sized to pass a continuous-form print medium. A long axis of the microwave waveguides are positioned across a width of a media path of the continuous-from print medium. Electromagnetic energy transported along the microwave waveguides is used to dry wet colorants applied to the continuous-form print medium. At least one of the microwave waveguides has an offset from other microwave waveguides that is perpendicular to the media path of the continuous-form print medium. The offset reduces an attenuation of the electromagnetic energy in microwave waveguide(s) that are offset.

One embodiment comprises a serpentine microwave dryer that dries a wet colorant applied to a continuous-form print medium by a printing system. The serpentine microwave dryer includes a microwave source that generates electromagnetic energy to dry the wet colorant, and a first microwave waveguide having a long axis that is positioned across a width of a media path of the continuous-form print medium, where the first microwave waveguide has a first end that is electromagnetically coupled to the microwave source, a second end distal to the first end, and a first passageway through a short axis of the first microwave waveguide that is sized to pass the continuous-form print medium from the printing system through the first microwave waveguide. The serpentine microwave dryer further includes a second microwave waveguide having a long axis that is positioned across the width of the media path, where the second microwave waveguide has a third end that is electromagnetically coupled to the second end of the first microwave waveguide, a fourth end distal to the third end, and a second passageway through a short axis of the second microwave waveguide that is sized to pass the continuous-form print medium from the first microwave waveguide through the second microwave waveguide, where the second microwave waveguide has a first offset that is perpendicular to a plane of the media path from the first microwave waveguide to reduce an attenuation of the electromagnetic energy at the second microwave waveguide.

Another embodiment comprises a method of fabricating a serpentine microwave dryer that dries a wet colorant applied to a continuous-form print medium by a printing system. The method comprises positioning a long axis of a first microwave waveguide across a width of a media path of the continuous-form print medium, where the first microwave waveguide has a first end that is electromagnetically coupled to a microwave source that generates electromagnetic energy, a second end distal to the first end, and a first passageway through a short axis of the first microwave waveguide that is sized to pass the continuous-form print medium from the printing system through the first microwave waveguide. The method further comprises positioning a long axis of a second microwave waveguide across the width of the media path, where the second microwave waveguide has a third end that is electromagnetically coupled to the second end of the first microwave waveguide, a fourth end distal to the first end, and a second passageway through a short axis of the second microwave waveguide that is sized to pass the continuous-form print medium from the first microwave waveguide through the second microwave waveguide. The method further comprises offsetting the second microwave waveguide perpendicular to a plane of the media path a first amount from the first microwave waveguide to reduce an attenuation of the electromagnetic energy at the second microwave waveguide.

Another embodiment comprises a printing system that includes a printer that applies a wet colorant to a continuous-form print medium. The printing system further includes a serpentine microwave dryer downstream of the printer along a media path of the continuous-form print medium that dries the wet colorant utilizing electromagnetic energy. The serpentine microwave dryer includes a 2.4 Gigahertz microwave source that generates electromagnetic energy to dry the wet colorant, and a first microwave waveguide having a long axis that is positioned across a width of the media path, a first end that is electromagnetically coupled to the 2.4 Gigahertz microwave source, a second end distal to the first end, and a first passageway through a short axis of the first microwave waveguide that is sized to pass the continuous-form print medium from the printing system through the first microwave waveguide. The serpentine microwave dryer further includes a bend coupler electromagnetically coupled to the second end of the first microwave waveguide, and a second microwave waveguide having a long axis that is positioned across the width of the media path, a third end that is electromagnetically coupled to the bend coupler, a fourth end distal to the third end, and a second passageway through a short axis of the second microwave waveguide that is sized to pass the continuous-form print medium from the first microwave waveguide through the second microwave waveguide, where the second microwave waveguide has an first offset between 1 millimeter and 5 millimeters that is perpendicular to a plane of the media path from the first microwave waveguide to reduce an attenuation of the electromagnetic energy at the second microwave waveguide.

Other exemplary embodiments may be described below.

DESCRIPTION OF THE DRAWINGS

Some embodiments of the present invention are now described, by way of example only, and with reference to the accompanying drawings. The same reference number represents the same element or the same type of element on all drawings.

DESCRIPTION OF THE EMBODIMENTS

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
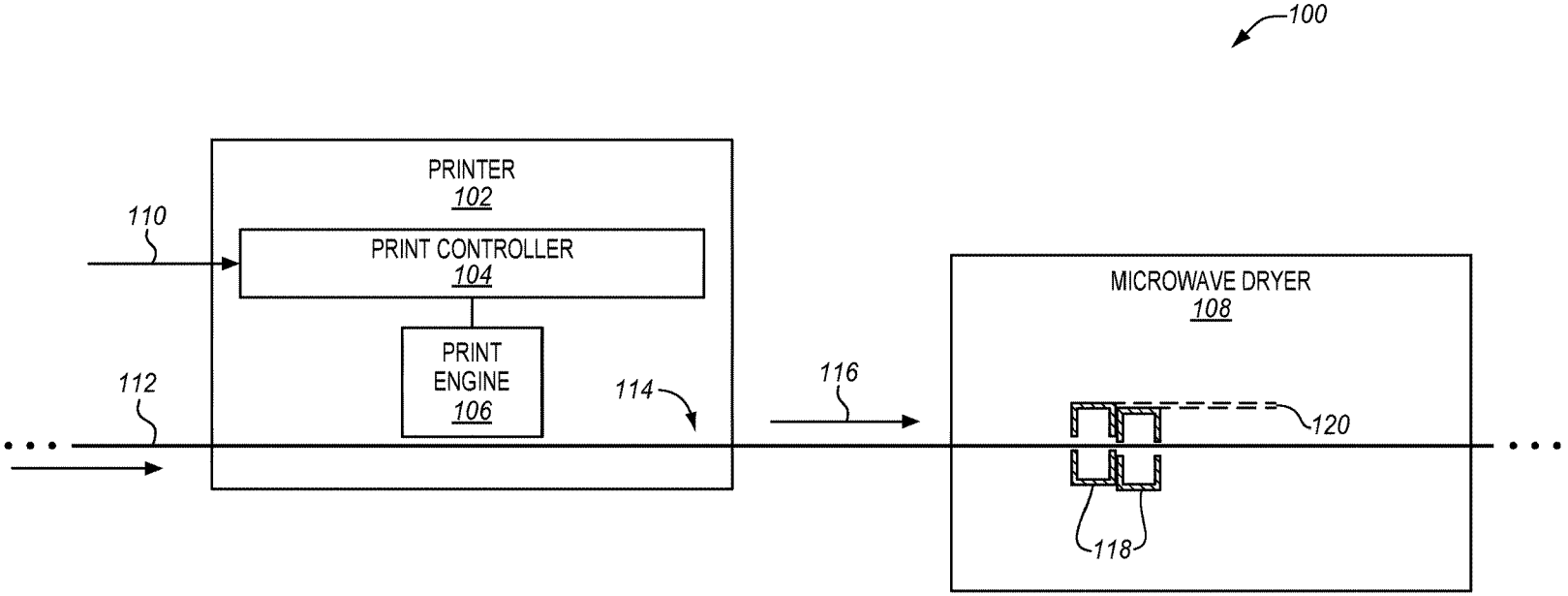
FIG. 1 is a block diagram of a printing system in an exemplary embodiment.

FIG. 1 is a block diagram of a printing system 100 in an exemplary embodiment. FIG. 1 also illustrates a print medium 112 (e.g., a continuous-form print medium or a cut-sheet print medium) that is marked by printer 102 with a wet or liquid colorant. Some examples of wet or liquid colorants include aqueous inks. Print medium 112 travels along a media path 116 in FIG. 1.

In this embodiment, printing system 100 includes a printer 102 and a serpentine microwave dryer 108. Printer 102 applies a wet colorant to a top side 114 of print medium 112, which is then dried by serpentine microwave dryer 108. In printing system 100, a print controller 104 of printer 102 receives print data 110 for imprinting onto print medium 112, which is rasterized by print controller 104 into bitmap data. The bitmap data is used by a print engine 106 (e.g., a drop-on-demand print engine, a continuous-ejection print engine, etc.) of printer 102 to apply wet colorants to print medium 112. Print medium 112 travels downstream of printer 102 to serpentine microwave dryer 108. Serpentine microwave dryer 108 applies electromagnetic energy (e.g., microwave energy) to print medium 112 utilizing one or more microwave waveguides 118, which heat the wet colorants applied to print medium 112 and evaporates a liquid portion of the wet colorants. This fixes the wet colorants to print medium 112. In this embodiment, microwave waveguides 118 have an offset 120 (e.g. a first offset) from each other that improves the drying capability for serpentine microwave dryer 108 by reducing the attenuation that occurs in waveguides that are aligned in the same plane. Although printer 102 and serpentine microwave dryer 108 are illustrated as separate elements in FIG. 1, printer 102 and serpentine microwave dryer 108 may be combined in some embodiments.

In serpentine microwave dryers, microwave waveguides have a long axis that span a width of media path 116 of the print medium, and further include passageways through a short axis that are sized to pass the print medium through the microwave waveguides. The microwave waveguides are also electromagnetically coupled together in a pattern such that microwave energy injected into one end of a microwave waveguide follows a serpentine path (e.g., an "S" pattern) from one end to another end of each of the microwave waveguides.

Figure 2:
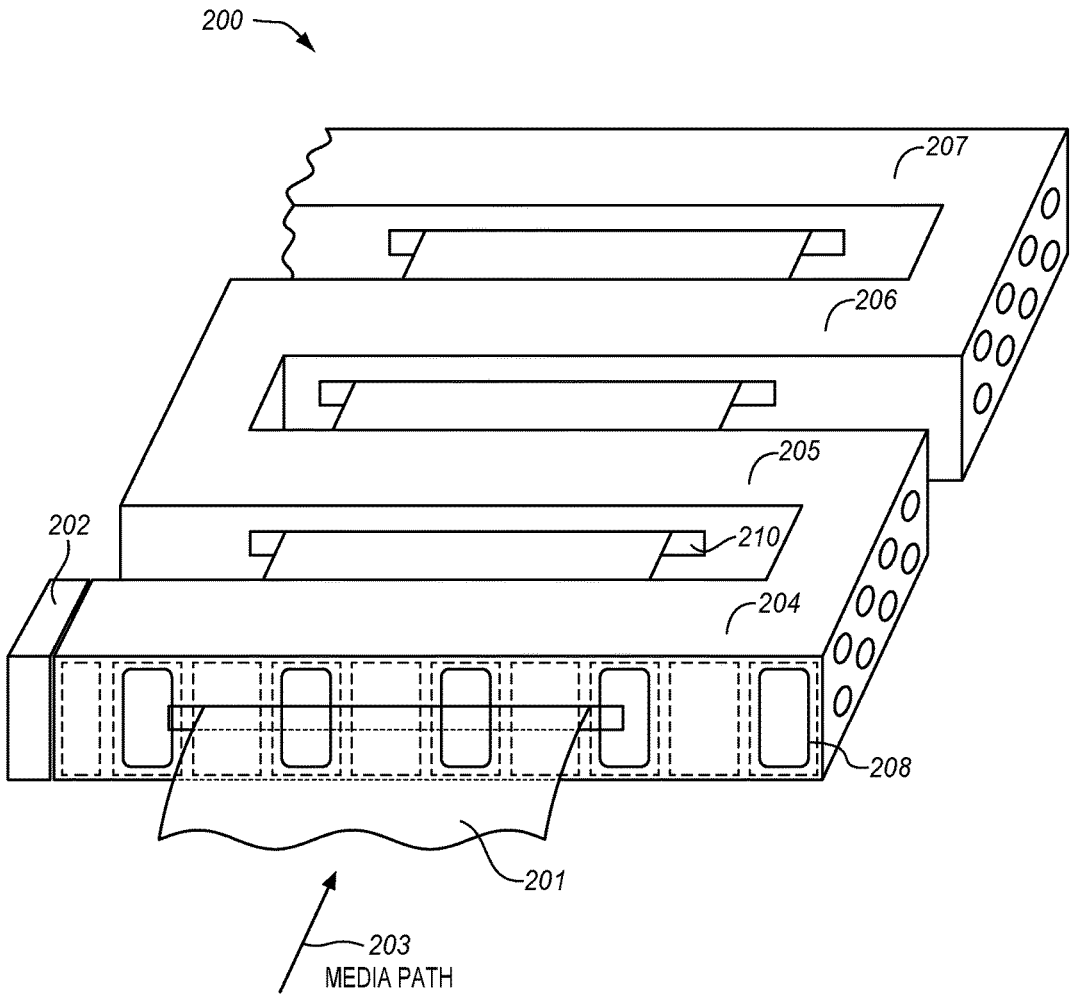
FIG. 2 is a block diagram of a serpentine microwave dryer in an exemplary embodiment.

FIG. 2 is a block diagram of a serpentine microwave dryer 200 in an exemplary embodiment. Serpentine microwave dryer 200 includes a plurality of microwave waveguides 204-207 that are positioned to have a long axis across a width of a print medium 201 and parallel to each other along a media path 203. Print medium 201 travels along media path 203 through passageways 210 across a short axis of each of microwave waveguides 204-207 (only shown for microwave waveguide 205 for illustrative purposes). Microwave waveguides 204-207 are electromagnetically coupled with each other. A magnetron 202 generates microwaves, which are injected into one end of microwave waveguide 204. The microwaves travel from left to right in microwave waveguide 204 in FIG. 2, are re-directed to microwave waveguide 206 (e.g., using bend coupler such as an e-bend), and then travel from right to left in microwave waveguide 206. This back and forth pattern continues for microwave waveguides 206-207, with the microwaves taking a serpentine path through microwave waveguides 204-207. At the last microwave waveguide, a shorting plate (not shown) may be located at the microwave waveguide un-coupled end as a termination element. In FIG. 2, the microwaves are illustrated within waveguide 204 as a plurality of rectangular features 208 that represent a standing wave. Within rectangular features 208, the standing wave of microwaves forms Radio Frequency (RF) peaks in the RF levels for the microwaves. For instance, within rectangular features 208, the RF level may be high, while in between rectangular features 208, the RF levels may be low. The result is a series of high RF level spots and low RF level spots (i.e. hot and cold spots) that vary across the width of print medium 201.

In serpentine microwave dryer 200, each of microwave waveguides 204-207 lie in the same plane. For example, if each of microwave waveguides 204-207 has the same height, width, and length, then the top surfaces of microwave waveguides 204-207 are aligned and the bottom surfaces of microwave waveguides 204-207 are aligned.

As the microwaves travel from microwave waveguide 204 to microwave waveguide 207, the presence of print medium 201 within microwave waveguides 204-207 attenuates the electric field strength of the microwave energy from one waveguide to another at the same operating point (e.g., at the same point within subsequent waveguides along media path 203). The result of this is that for the same operating point, the electric field strength in microwave waveguide 207 is lower than the electric field strength in microwave waveguide 204.

Figure 3:
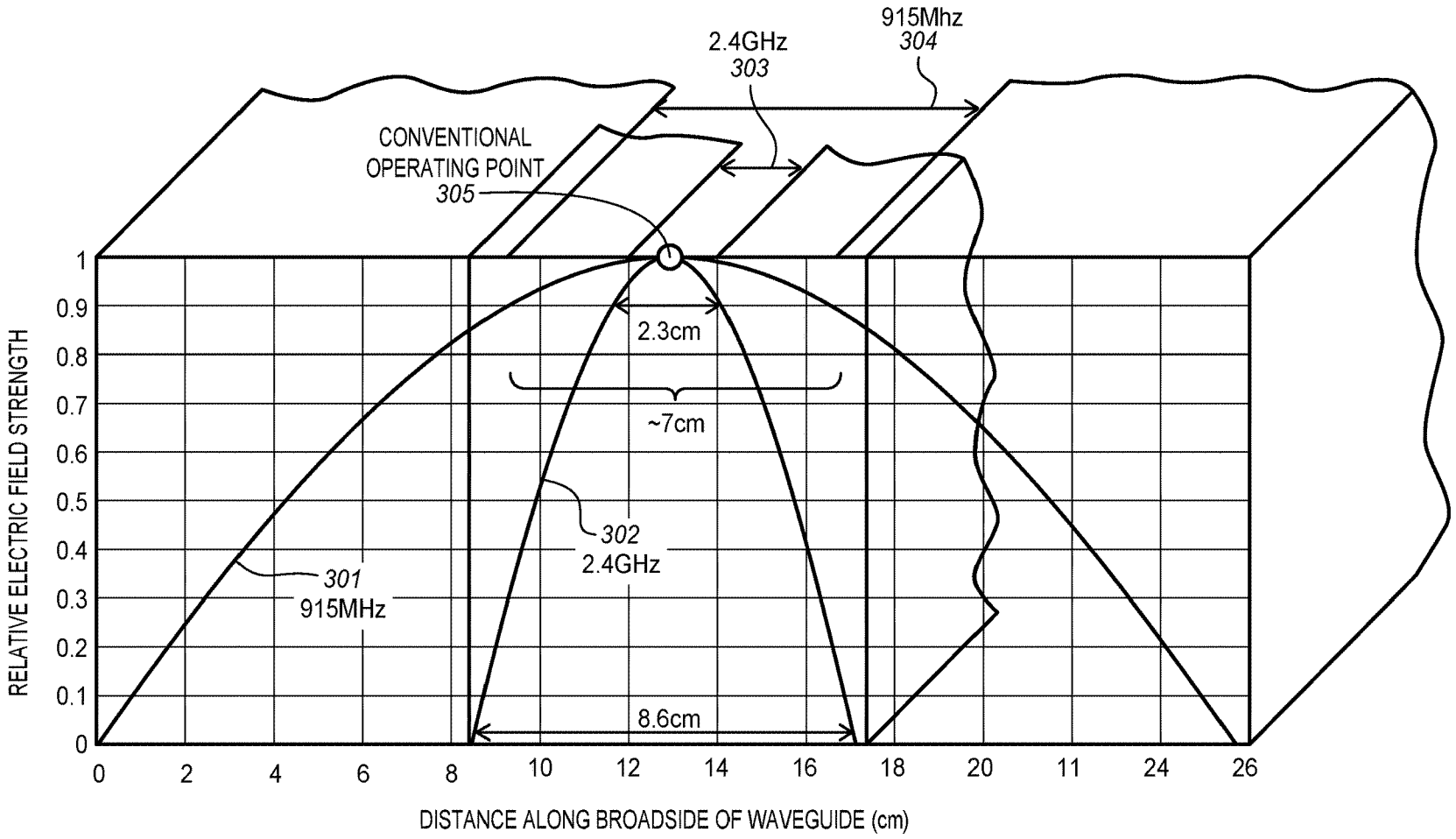
FIG. 3 illustrates the relative electric field strength for microwave waveguides that operate at different frequencies in an exemplary embodiment.

FIG. 3 illustrates the relative electric field strength for microwave waveguides that operate at different frequencies in an exemplary embodiment without the effects from the presence of print medium within the microwave waveguides. A 2.4 Gigahertz (GHz) waveguide may have a height of about 8.6 centimeters (cm), while a 915 Megahertz (MHz) waveguide may have a height of about 26 cm (illustrated in the horizontal axis in FIG. 3). Differences in the heights are due to the different frequencies. A 2.4 GHz waveguide may have a passageway with a height 303 of about 2.3 cm, while a 915 MHz waveguide may have a passageway with a height 304 of about 7 cm. The differences in the heights are again due to the different frequencies. In this embodiment, widths 303-304 have been selected to encompass 90% of the relative electric field strength.

A conventional operating point 305 is illustrated in FIG. 3, which is centered within heights 303-304. Conventional operating point 305 is also where the relative electric field strength graphs of the 2.4 GHz waveguide and the 915 MHz wave guide are at their peak. In FIG. 3, the 915 MHz relative electric field strength is illustrated as plot 301, and the 2.4 GHz relative electric field strength is illustrated as plot 302. Ideally, the electric field strength at conventional operating point 305 would be the same for each of microwave waveguides 204-207, since this would result in the same effective drying power for drying colorants applied to print medium 201 for each of microwave waveguides 204-207. However, the presence of print medium 201 within passageways 210 reduces the electric field strength for microwave waveguides 204-207 at the same operating point (e.g., conventional operating point 305). This reduction is more pronounced at microwave waveguide 207 than at microwave waveguide 204. That is, the effects are cumulative along media path 203 of print medium 201.

Figure 4:
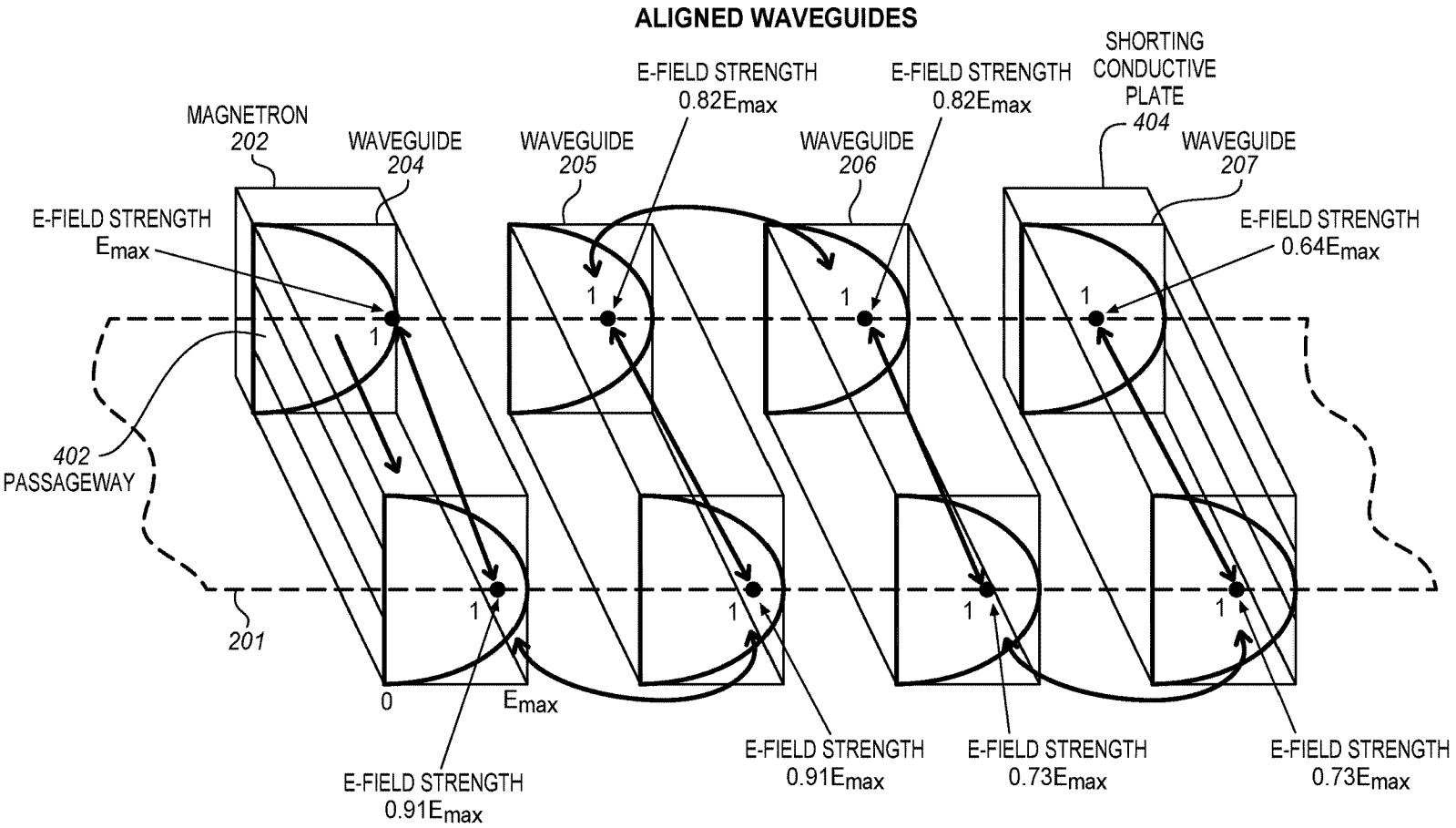
FIG. 4 illustrates the cumulative effect in the reduction of the relative electric field strength across aligned microwave waveguides in an exemplary embodiment.

FIG. 4 illustrates the cumulative effect in the reduction of the relative electric field strength across microwave waveguides 204-207 that are aligned in an exemplary embodiment. In FIG. 4, microwave waveguides 204-207 are aligned in the same plane. In FIG. 4, magnetron 202 injects microwaves at one end of microwave waveguide 204, which traverse microwave waveguide 204 along a long axis to another end of microwave waveguide 204. The electric field strength where magnetron 202 is located is considered to be $E_{max}$, or at a maximum electric field strength. At the end of microwave waveguide 204 distal to magnetron 202, the electric field strength at the same operating point (e.g., conventional operating point 305 illustrated in FIG. 2), is reduced to about $0.91E_{max}$. Microwave waveguide 204 is electromagnetically coupled to microwave waveguide 205, and the serpentine path of microwave transmission continues through microwave waveguide 205.

FIG. 4 illustrates how the electric field strength is reduced across microwave waveguides 204-207 when microwave waveguides 204-207 are aligned (e.g., microwave waveguides 204-207 lie in the same plane). At microwave waveguide 207, the electric field strengths are $0.64E_{max}$ and $0.73E_{max}$, which represents a reduction of 27% and 36% as compared to $E_{max}$. The result of this reduction is that microwave waveguide 207 is less efficient and effective in drying print medium 201 as compared to microwave waveguide 204. This reduces the drying capability of serpentine microwave dryers that utilize aligned waveguides (e.g., waveguides that lie in the same plane). A shorting plate 404 at microwave waveguide 207 forms a termination element.

Figure 5:
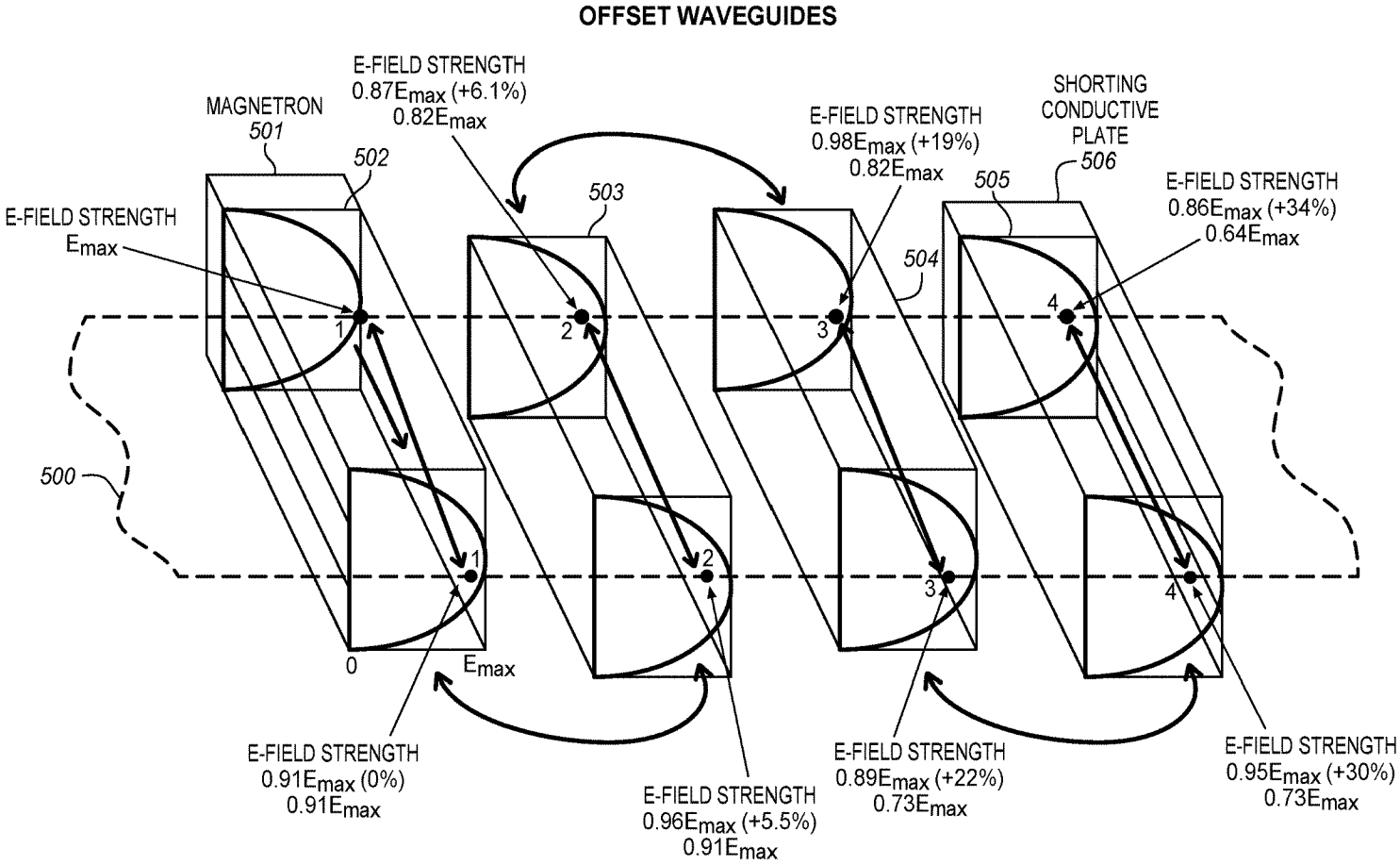
FIG. 5 illustrates the cumulative effect in the reduction of the electric field strength across offset microwave waveguides in an exemplary embodiment.

FIG. 5 illustrates the cumulative effect in the reduction of the electric field strength across offset microwave waveguides 502-505 in an exemplary embodiment. In FIG. 5, microwave waveguides 502-503 are vertically offset from each other (e.g., they are offset perpendicular to a major surface of a print medium 500, which moves the operating point for print medium 500 to different locations within microwave waveguides 502-505. In FIG. 5, the operating point for microwave waveguide 502 is marked as a "1", the operating point for microwave waveguide 503 is marked with a "2", the operating point for microwave waveguide 504 is marked with a "3", and the operating point for microwave waveguide 505 is marked with a "4". The term "offset" refers to generating an offset between microwave waveguides 502-505 that is perpendicular to the major surface of print medium 500. For example, if each of microwave waveguides 502-505 has the same height, width, and length, then the top surfaces of microwave waveguides 502-505 are not aligned with each other and the bottom surfaces of microwave waveguides 502-505 are not aligned with each other. Although four different offsets are illustrated in FIG. 5, fewer offsets may be implemented as desired. For instance, three different operating points may be implemented; two different operating points may be implemented, etc. Therefore, the depiction of 4 different operating points in FIG. 5 is merely presented for the purposes of illustrating one possible implementation. The number and location of operating points 1-4 is adjustable by varying the offset between microwave waveguides 502-505 (e.g., by varying the amounts of offset).

In FIG. 5, magnetron 501 injects microwaves at one end of microwave waveguide 502, which traverse microwave waveguide 502 along a long axis to another end of microwave waveguide 502. The electric field strength where magnetron 501 is located is considered to be $E_{max}$, or at a maximum electric field strength. At the end of microwave waveguide 502 distal to magnetron 501, the electric field strength at the same operating point (e.g., operating point "1" illustrated in FIG. 5), is reduced to about $0.91E_{max}$. Microwave waveguide 502 is electromagnetically coupled to microwave waveguide 503, and the serpentine path of microwave transmission continues through microwave waveguide 505.

FIG. 5 illustrates how the electric field strength is reduced to a lesser extent across microwave waveguides 502-505 when microwave waveguides 502-505 are offset from each other. At microwave waveguide 505, the electric field strengths are $0.86E_{max}$ and $0.95E_{max}$, which is +34% and +30% higher, respectively, than the aligned microwave waveguide 204 illustrated in FIG. 4. The result is that even though microwave waveguide 505 is slightly less efficient and effective for drying print medium 500 than microwave waveguide 502, the efficiency is reduced less than the vertically aligned microwave waveguides 202-205 of FIG. 4. Therefore, offset microwave waveguides 502-505 improves the drying efficiency and drying capability for serpentine microwave dryers as compared to the prior art. A shorting plate 506 at microwave waveguide 506 forms a termination element.

Figure 6:
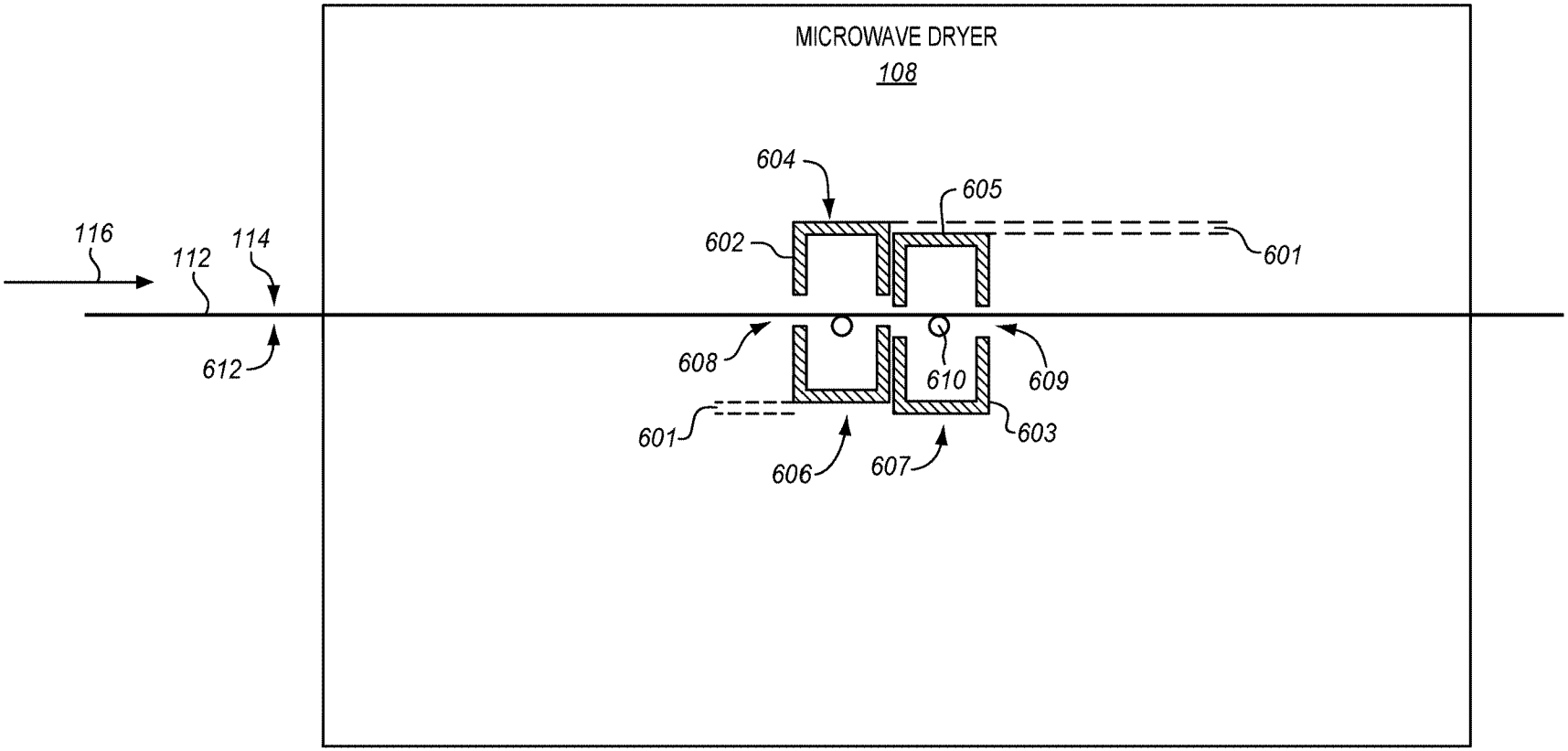
FIG. 6 illustrates a side view of the serpentine microwave dryer of FIG. 1 that includes microwave waveguides that are offset from each other in an exemplary embodiment.

FIG. 6 illustrates a side view of serpentine microwave dryer 108 that includes a first and second microwave waveguides 602-603 that are offset from each other in an exemplary embodiment. In this side view, a long axis of first and second microwave waveguides 602-603 is into the page in order to detail an offset 601 (e.g., a first offset) that is present between first and second microwave waveguides 602-603. In this embodiment, first microwave waveguide 602 has a top surface 604 that has an offset 601 from a top surface 605 of second microwave waveguide 603. First microwave waveguide 602 also has a bottom surface 606 that has offset 601 from a bottom surface 607 of second microwave waveguide 603. Offset 601 is a displacement between first microwave waveguide 602 and second microwave waveguide 603 that is perpendicular to a plane of media path 116 (e.g., vertically displaced in FIG. 6). First microwave waveguide 602 further includes a first passageway 608 through a short axis that is sized to pass print medium 112 through an interior of first microwave waveguide 602. For example, first passageway 608 may have a width (into the page in this view) that is at least as wide as print medium 112. Second microwave waveguide 603 further includes a second passageway 609 through a short axis that is sized to pass print medium 112 from first microwave waveguide 602 through an interior of second microwave waveguide 603. For example, second passageway 609 may have a width (into the page in this view) that is at least as wide as print medium 112.

In some embodiments, offset 601 is based on a tolerance for a movement of print medium 112 perpendicular to a plane of media path 116 (e.g., vertically displacement of print medium 112 in FIG. 6, and/or offset 601 is based on a frequency of electromagnetic energy. For example, if the frequency of electromagnetic energy is 2.4 GHz, then offset 601 may be between 1 millimeter and 5 millimeters. Generally, the value of offset 601 is selected to vary the operating point between first microwave waveguide 602 and second microwave waveguide 603, similar to how the operating points vary in FIG. 5. Further, varying the operating point may be constrained to maintain the RF energy at the operating point within a specific range (e.g., within 90% of the maximum effective RF power).

In some embodiments, first and second microwave waveguides 602-603 may include a plurality of guides 610 that prevent print medium 112 from fluttering and/or contacting the interior of first and second microwave waveguides 602-603. Guides 610 are in contact with print medium 112 on a side (e.g., a bottom side 612) that does not include the wet colorant. Guides 610 may comprise rods, roller, or combinations of rods and roller. Guides 610 may also be formed from a material that is transparent to electromagnetic energy. This prevents guides 610 from interfering with the transmission of electromagnetic energy within first and second microwave waveguides 602-603.

Figure 7:
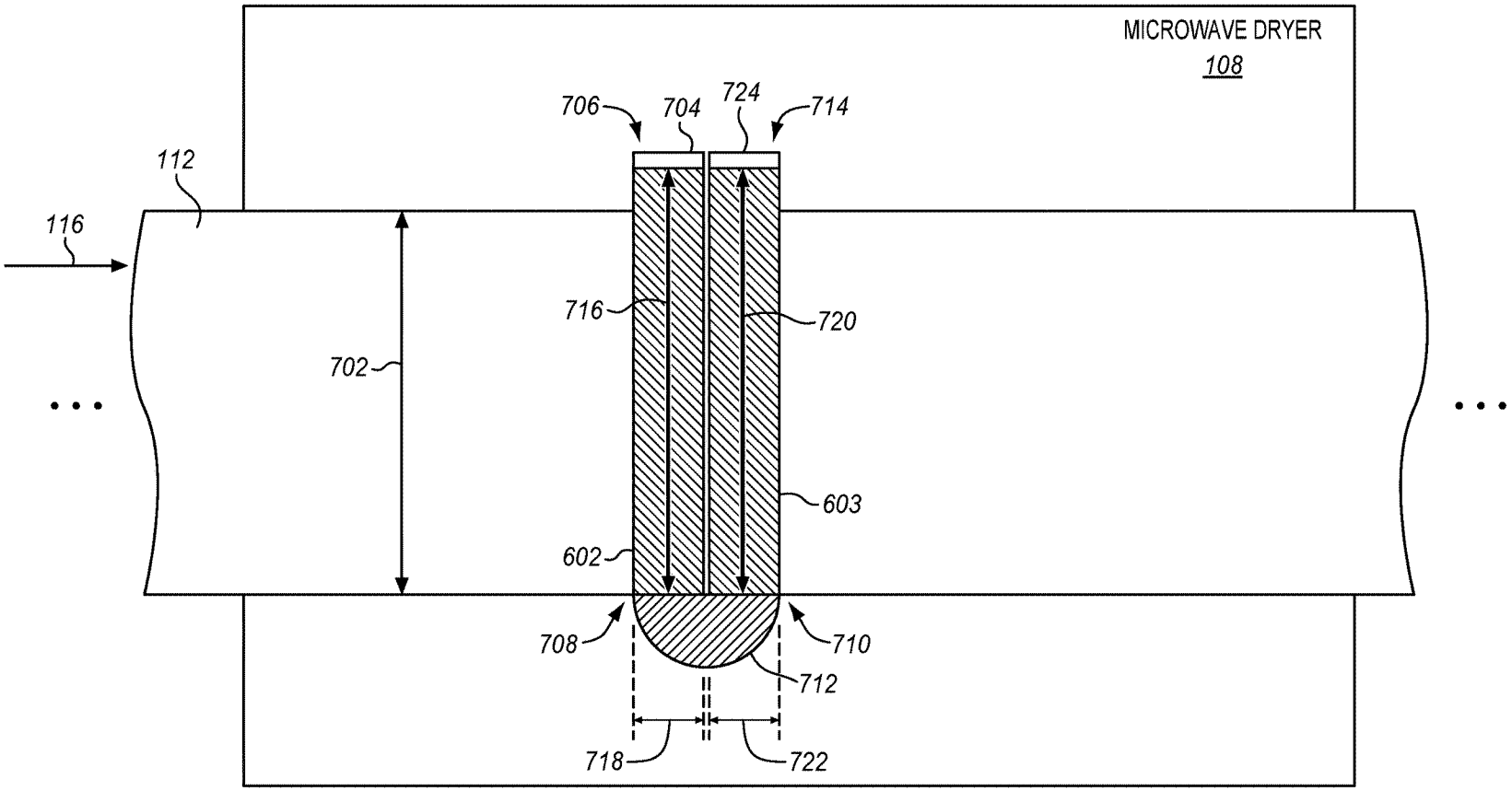
FIG. 7 illustrates a top view of the serpentine microwave dryer of FIG. 1 that includes the microwave waveguides of FIG. 6 in an exemplary embodiment.

FIG. 7 illustrates a top view of serpentine microwave dryer 108 that includes first and second microwave waveguides 602-603 in an exemplary embodiment. In this top view, a short axis 718 and 722 of first and second microwave waveguides 602-603, respectfully, is across the page. A long axis 716 and 720 of first and second microwave waveguides 602-603, respectfully, span a width 702 of media path 116 for print medium 112. The length of microwave waveguides 602-603 is selected to accommodate a width of first passageway 608 and second passageway 609. In this embodiment, a microwave source 704 is electromagnetically coupled to a first end 706 of first microwave waveguide 602, and generates electromagnetic energy (see FIG. 1) to dry the wet colorants applied to print medium 112. First microwave waveguide 602 further includes a second end 708 that is distal to first end 706 and is electromagnetically coupled to a first end 710 of second microwave waveguide 603. For example, the electromagnetic coupling may be performed by a bend coupler 712 (e.g., an e-bend coupler) that electromagnetically couples first microwave waveguide 602 to second microwave waveguide 603.

Electromagnetic energy generated by microwave source 704 travels from first end 706 of first microwave waveguide 602 to second end 708 of first microwave waveguide 602, where bend coupler 712 (e.g., an e-bend coupler) is able to re-direct electromagnetic energy into second microwave waveguide 603. Electromagnetic energy then travels from third end 710 of second microwave waveguide 603 to a fourth end 714 of second microwave waveguide 603 that is distal to third end 710. If second microwave waveguide 603 is the last waveguide in a row of waveguides, then a shorting plate 724 may be located at second end 714 of second microwave waveguide 603 as a termination element.

Although FIGS. 6-7 illustrate two waveguides for serpentine microwave dryer 108, any number of microwave waveguides may be utilized as a matter of design choice to achieve a desired level of performance for drying wet colorants applied to print medium 112 by printer 102. In another embodiment, three microwave waveguides may be coupled together as previously described with the offset between a first and second waveguide different than the offset between the second and third waveguide to reduce attenuation of the electromagnetic energy at the third waveguide.

Figure 8:
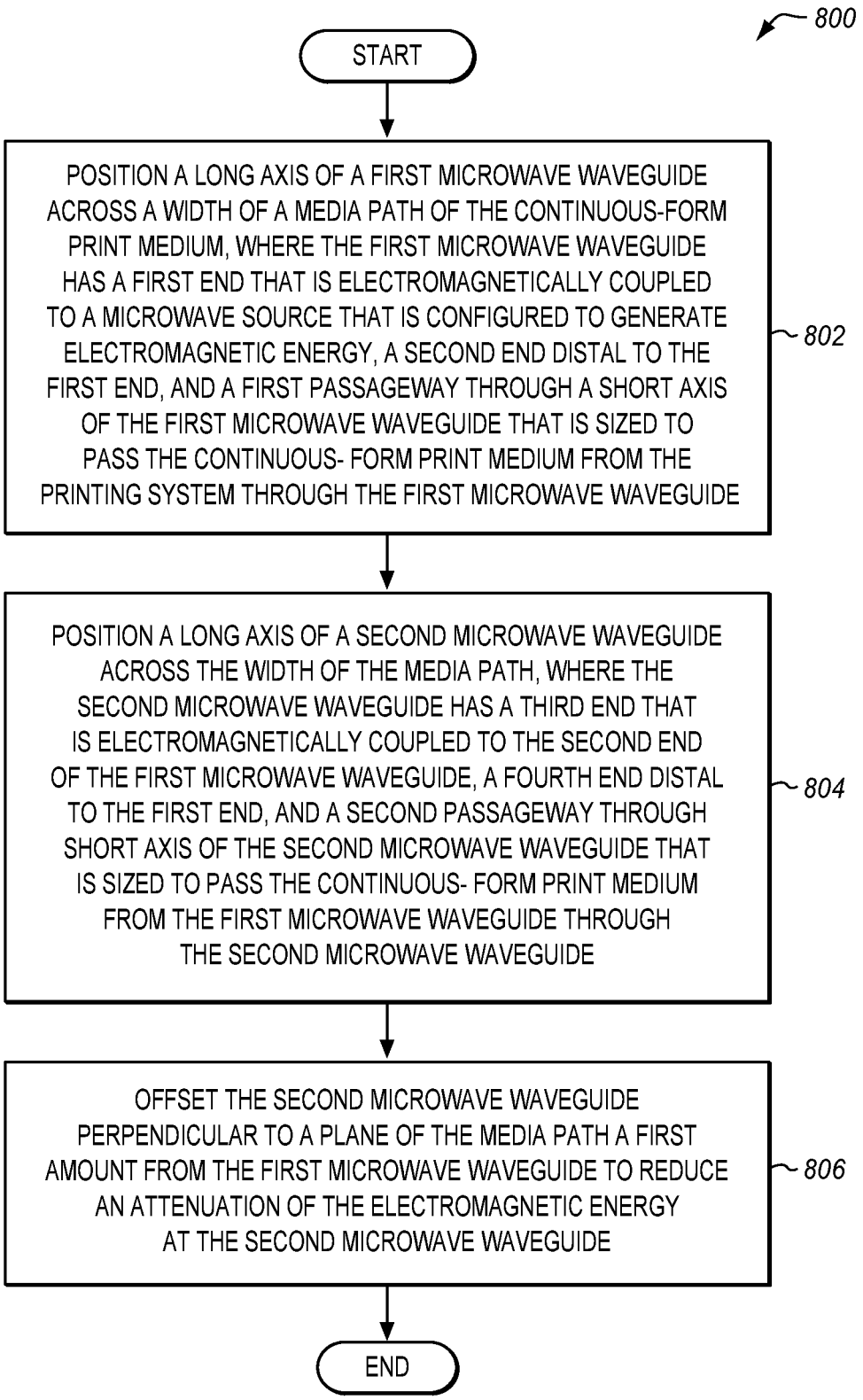
FIG. 8 is a flow chart of a method of fabricating a serpentine microwave dryer having offset microwave waveguides in an exemplary embodiment.

FIG. 8 is a flow chart of a method 800 of fabricating a serpentine microwave dryer having offset microwave waveguides in an exemplary embodiment. Method 800 will be discussed with respect to serpentine microwave dryer 108 of FIG. 1 and FIGS. 6-7, although method 800 may apply to other microwave dryers, not shown. The steps of method 800 are not inclusive, and method 800 may include other steps, not shown. Further, the steps of method 800 may be performed in an alternate order.

To fabricate serpentine microwave dryer 108, first microwave waveguide 602 has a long axis 716 that is positioned across width 702 of media path 116 for print medium 112. As discussed previously, first microwave waveguide 602 has microwave source 704 coupled to first end 706, which generates electromagnetic energy. First microwave waveguide 602 also includes first passageway 608 through a short axis 718, which is sized to pass print medium 112 through an interior of first microwave waveguide 602 (see FIGS. 6-7 and step 802). Second microwave waveguide 603 has a long axis 720 positioned across width 702 of media path 116 of print medium 112, and includes second passageway 609 through a short axis 722 that is sized to pass print medium 112 through an interior of second microwave waveguide 603 (see FIGS. 6-7 and step 804). Second microwave waveguide 603 is offset 601 perpendicular to a plane of media path 116 with respect to first microwave waveguide 602 by an amount (e.g., a first amount, which may be between 1-5 millimeters), thereby reduces an attenuation of electromagnetic energy at second microwave waveguide 603 (see step 806, FIG. 6, and the previous discussion with respect to FIG. 5).

Utilizing offset waveguides, the efficiency and drying performance of serpentine microwave dryer 108 is improved over aligned waveguides. This improvement may result in lower operating costs for serpentine microwave dryer 108, since the overall efficiency of serpentine microwave dryer 108 has been increased (e.g., lower electrical costs). This improvement may also result in reducing the footprint for serpentine microwave dryer 108, since a fewer number of waveguides may be sufficient to ensure that the wet colorants applied to print medium 112 are adequately dried.

Although specific embodiments were described herein, the scope of the invention is not limited to those specific embodiments. The scope of the invention is defined by the following claims and any equivalents thereof.

What is claimed is:

1. A serpentine microwave dryer configured to dry a wet colorant applied to a continuous-form print medium by a printing system, the serpentine microwave dryer comprising:

a microwave source configured to generate electromagnetic energy to dry the wet colorant;

a first microwave waveguide having a long axis that is positioned across a width of a media path of the continuous-form print medium, wherein the first microwave waveguide has a first end that is electromagnetically coupled to the microwave source, a second end distal to the first end, and a first passageway through a short axis of the first microwave waveguide that is sized to pass the continuous-form print medium from the printing system through the first microwave waveguide, wherein the first passageway is centered within the first microwave waveguide; and a second microwave waveguide having a long axis that is positioned across the width of the media path, wherein the second microwave waveguide has a third end that is electromagnetically coupled to the second end of the first microwave waveguide, a fourth end distal to the third end, and a second passageway through a short axis of the second microwave waveguide that is sized to pass the continuous-form print medium from the first microwave waveguide through the second microwave waveguide, wherein the second passageway is centered within the second microwave waveguide, wherein the second microwave waveguide has a first offset that is perpendicular to a plane of the media path from the first microwave waveguide to reduce an attenuation of the electromagnetic energy at the second microwave waveguide.

2. The serpentine microwave dryer of claim 1, further comprising:

a third microwave waveguide having a long axis that is positioned across the width of the media path, wherein the third microwave waveguide has a fifth end that is electromagnetically coupled to the fourth end of the second microwave waveguide, a sixth end distal to the fifth end, and a third passageway through a short axis of the third microwave waveguide that is sized to pass the continuous-form print medium from the second microwave waveguide through the third microwave waveguide, wherein the third passageway is centered within the third microwave waveguide, wherein the third microwave waveguide has a second offset that is perpendicular to the plane of the media path from the first microwave waveguide and the second microwave waveguide to reduce an attenuation of the electromagnetic energy at the third microwave waveguide.

3. The serpentine microwave dryer of claim 1, wherein:

the electromagnetic energy of the microwave source has a frequency of 2.4 Gigahertz; and the first offset is between 1 millimeter and 5 millimeters.

4. The serpentine microwave dryer of claim 1, wherein:

the first offset is based on a tolerance for movement of the continuous-form print medium perpendicular to the plane of the media path.

5. The serpentine microwave dryer of claim 4, wherein:

the first offset is based on a frequency of the electromagnetic energy of the microwave source.

6. The serpentine microwave dryer of claim 1, further comprising:

a plurality of guides disposed within at least one of the first microwave waveguide and the second microwave waveguide that are configured to contact the continuous-form print medium on a side of the continuous-form print medium that does not include the wet colorant.

7. The serpentine microwave dryer of claim 6, wherein:

the plurality of guides comprises rods, rollers, or combinations of the rods and the rollers.

8. The serpentine microwave dryer of claim 6, wherein:

the plurality of guides comprises a material that is transparent to the electromagnetic energy of the microwave source.

9. The serpentine microwave dryer of claim 1, further comprising:

a bend coupler that electromagnetically couples the second end of the first microwave waveguide to the third end of the second microwave waveguide.

10. A method of fabricating a serpentine microwave dryer configured to dry a wet colorant applied to a continuous-form print medium by a printing system, the method comprising:

positioning a long axis of a first microwave waveguide across a width of a media path of the continuous-form print medium, wherein the first microwave waveguide has a first end that is electromagnetically coupled to a microwave source that is configured to generate electromagnetic energy, a second end distal to the first end, and a first passageway through a short axis of the first microwave waveguide that is sized to pass the continuous-form print medium from the printing system through the first microwave waveguide, wherein the first passageway is centered within the first microwave waveguide;

positioning a long axis of a second microwave waveguide across the width of the media path, wherein the second microwave waveguide has a third end that is electromagnetically coupled to the second end of the first microwave waveguide, a fourth end distal to the first end, and a second passageway through a short axis of the second microwave waveguide that is sized to pass the continuous-form print medium from the first microwave waveguide through the second microwave waveguide, wherein the second passageway is centered within the second microwave waveguide; and offsetting the second microwave waveguide perpendicular to a plane of the media path a first amount from the first microwave waveguide to reduce an attenuation of the electromagnetic energy at the second microwave waveguide.

11. The method of claim 10, further comprising:

positioning a third microwave waveguide having a long axis across the width of the media path, wherein the third microwave waveguide has a fifth end that is electromagnetically coupled to the fourth end of the second microwave waveguide, a sixth end distal to the fifth end, and a third passageway through a short axis of the third microwave waveguide that is sized to pass the continuous-form print medium from the second microwave waveguide through the third microwave waveguide, wherein the third passageway is centered within the third microwave waveguide; and offsetting the third microwave waveguide perpendicular to the plane of the media path a second amount from the first microwave waveguide and the second microwave waveguide to reduce an attenuation of the electromagnetic energy at the third microwave waveguide.

12. The method of claim 10, wherein:

the electromagnetic energy of the microwave source has a frequency of 2.4 Gigahertz; and the first amount is between 1 millimeter and 5 millimeters from the first microwave waveguide.

13. The method of claim 10, wherein:

the first amount is based on a tolerance for movement of the continuous-form print medium perpendicular to the plane of the media path.

14. The method of claim 13, wherein:

the first amount is based on a frequency of the electromagnetic energy of the microwave source.

15. The method of claim 10, further comprising:

positioning a plurality of guides within at least one of the first microwave waveguide and the second microwave waveguide that are configured to contact the continuous-form print medium on a side of the continuous-form print medium that does not include the wet colorant.

16. The method of claim 15, wherein:

the plurality of guides comprises rods, rollers, or combinations of the rods and the rollers.

17. The method of claim 15, wherein:

the plurality of guides comprises a material that is transparent to the electromagnetic energy of the microwave source.

18. A printing system, comprising:

a printer configured to apply a wet colorant to a continuous-form print medium; and a serpentine microwave dryer downstream of the printer along a media path of the continuous-form print medium that is configured to dry the wet colorant utilizing electromagnetic energy, the serpentine microwave dryer comprising:

a 2.4 Gigahertz microwave source configured to generate electromagnetic energy to dry the wet colorant;

a first microwave waveguide having a long axis that is positioned across a width of the media path, a first end that is electromagnetically coupled to the 2.4 Gigahertz microwave source, a second end distal to the first end, and a first passageway through a short axis of the first microwave waveguide that is sized to pass the continuous-form print medium from the printing system through the first microwave waveguide, wherein the first passageway is centered within the first microwave waveguide;

a bend coupler electromagnetically coupled to the second end of the first microwave waveguide; and a second microwave waveguide having a long axis that is positioned across the width of the media path, a third end that is electromagnetically coupled to the bend coupler, a fourth end distal to the third end, and a second passageway through a short axis of the second microwave waveguide that is sized to pass the continuous-form print medium from the first microwave waveguide through the second microwave waveguide, wherein the second passageway is centered within the second microwave waveguide, wherein the second microwave waveguide has an first offset between 1 millimeter and 5 millimeters that is perpendicular to a plane of the media path from the first microwave waveguide to reduce an attenuation of the electromagnetic energy at the second microwave waveguide.

19. The printing system of claim 18, wherein the serpentine microwave dryer further comprises:

a third microwave waveguide having a long axis that is positioned across the width of the media path, wherein the third microwave waveguide has a fifth end that is electromagnetically coupled to the fourth end of the second microwave waveguide, a sixth end distal to the fifth end, and a third passageway through a short axis of the third microwave waveguide that is sized to pass the continuous-form print medium from the second microwave waveguide through the third microwave waveguide, wherein the third passageway is centered within the third microwave waveguide, wherein the third microwave waveguide has a second offset perpendicular to the plane of the media path from the first microwave waveguide and the second microwave waveguide to reduce an attenuation of the electromagnetic energy at the third microwave waveguide.

20. The printing system of claim 18, wherein:

the first offset is based on a tolerance for movement of the continuous-form print medium perpendicular to the plane of the media path.

* * * * *